US011753862B2

(12) United States Patent
Johnson

(10) Patent No.: US 11,753,862 B2
(45) Date of Patent: Sep. 12, 2023

(54) POCKET DOOR FRAME

(71) Applicant: L.E. Johnson Products, Inc., Elkhart, IN (US)

(72) Inventor: Nathan Johnson, Elkhart, IN (US)

(73) Assignee: L.E. Johnson Products, Inc., Elkhart, IN (US)

( * ) Notice: Subject to any disclaimer, the term of this patent is extended or adjusted under 35 U.S.C. 154(b) by 23 days.

(21) Appl. No.: 17/004,071

(22) Filed: Aug. 27, 2020

(65) Prior Publication Data

US 2021/0062568 A1 Mar. 4, 2021

Related U.S. Application Data

(60) Provisional application No. 62/893,453, filed on Aug. 29, 2019.

(51) Int. Cl.

| | |
|---|---|
| ***E06B 1/52*** | (2006.01) |
| ***E04C 3/07*** | (2006.01) |
| ***E06B 3/46*** | (2006.01) |
| *E04B 2/72* | (2006.01) |
| *E04C 3/04* | (2006.01) |
| *E04B 2/82* | (2006.01) |

(52) U.S. Cl.

CPC ..... *E06B 1/52* (2013.01); *E06B 3/4654* (2013.01); *E04B 2/721* (2013.01); *E04B 2/825* (2013.01); *E04C 3/07* (2013.01); *E04C 2003/043* (2013.01)

(58) Field of Classification Search

CPC ..... E06B 1/52; E06B 3/4654; E04B 2/721

See application file for complete search history.

(56) References Cited

U.S. PATENT DOCUMENTS

| | | | | |
|---|---|---|---|---|
| 2,732,919 | A * | 1/1956 | Johnson | E05D 15/0652 49/372 |
| 2,818,608 | A * | 1/1958 | Ill | E06B 3/4654 52/292 |
| 2,832,105 | A | 4/1958 | Pearson | |
| 3,058,174 | A | 10/1962 | Sterling | |
| 3,400,490 | A | 9/1968 | Anderson | |
| 3,845,601 | A * | 11/1974 | Kostecky | E04B 1/2403 52/290 |
| 3,899,259 | A | 8/1975 | Boice | |
| 4,553,286 | A * | 11/1985 | Schwarz, II | E05D 5/04 16/382 |
| 4,742,645 | A * | 5/1988 | Johnston | E06B 3/4654 49/372 |

(Continued)

OTHER PUBLICATIONS

Johnson Hardware, 2060 Pocket Door Frame Features, Product Catalog, Aug. 2008, 2 pages.

(Continued)

*Primary Examiner* — Phi D A

(74) *Attorney, Agent, or Firm* — Barnes & Thornburg LLP

(57) ABSTRACT

A pocket door frame includes a stud having a first section, a second section, and a third section. The first section is perpendicular to the second section, and the third section is perpendicular to the second section. The first section includes a first opening. The stud also includes a second opening located at least partially in the second section and at least partially in the third section. The second opening is at least partially aligned with the first opening so as to provide access to the first opening through the second opening.

17 Claims, 4 Drawing Sheets

(56) References Cited

U.S. PATENT DOCUMENTS 5,157,883 A * 10/1992 Meyer ..... E04B 2/766 24/460
5,203,132 A * 4/1993 Smolik ..... E04B 2/7409 403/230
5,347,686 A * 9/1994 Tyler ..... E05D 5/023 16/382
5,419,089 A * 5/1995 Hill ..... E04B 1/24 52/656.9
5,566,523 A * 10/1996 Ozanne ..... E04B 2/58 52/271
5,590,505 A * 1/1997 Bogle ..... E04B 2/766 52/376
5,596,859 A * 1/1997 Horton ..... E04B 2/7453 52/481.1
5,605,016 A 2/1997 Pollard
D404,151 S 1/1999 Reichel
6,418,694 B1 * 7/2002 Daudet ..... E04B 5/10 52/262
D549,080 S 8/2007 Killins
D552,251 S 10/2007 McGinness
D556,920 S 12/2007 McGinness
7,739,850 B2 * 6/2010 Daudet ..... E04B 1/24 52/656.2
8,015,775 B2 * 9/2011 McMullen ..... E04C 3/32 52/834
D687,248 S 8/2013 Huston et al.
8,499,512 B2 * 8/2013 Pilz ..... E04B 1/24 52/235
8,695,310 B2 * 4/2014 Tremblay ..... E04C 3/292 52/775
8,720,141 B2 * 5/2014 Shembekar ..... E04F 13/0875 52/309.8
8,745,946 B2 * 6/2014 D'Alessandro ..... E04B 9/10 52/506.05
8,938,926 B2 * 1/2015 Sareyka ..... E04B 9/067 52/483.1
D724,240 S 3/2015 Ross
9,074,375 B2 7/2015 Duranleau
9,650,819 B2 5/2017 Bultschnieder et al.
9,863,147 B2 1/2018 Graziano
9,932,734 B1 * 4/2018 Winter ..... E04B 1/5831
10,036,195 B2 7/2018 Iglesias Ballester
10,041,249 B1 8/2018 Hebert et al.
10,202,752 B2 * 2/2019 Dunster ..... E04B 7/024
10,273,686 B2 4/2019 Lake
10,273,741 B1 4/2019 Summy
D848,379 S 5/2019 McKenny
10,280,617 B2 * 5/2019 Monty ..... F16B 7/0493
D863,043 S 10/2019 Schweiss
10,480,185 B1 * 11/2019 Attalla ..... E04C 3/32
D869,936 S 12/2019 Smith
D874,250 S 2/2020 Stoops
D877,603 S 3/2020 Barker
10,590,644 B2 3/2020 Naylor et al.
D882,831 S 4/2020 Carter
D886,569 S 6/2020 Vlad et al.
D887,298 S 6/2020 Machijima et al.
10,689,845 B1 6/2020 Bilge
10,697,227 B2 6/2020 Lehner, Jr. et al.
D902,701 S 11/2020 Smith
D902,702 S 11/2020 Smith
D904,218 S 12/2020 Kousik et al.
10,927,591 B1 2/2021 Brychell
10,961,698 B1 3/2021 Rampey et al.
10,988,971 B1 4/2021 Annazone, Jr. et al.
11,028,580 B2 * 6/2021 Burt ..... E04C 3/07
11,118,349 B2 * 9/2021 Montoya ..... E04B 7/06
2004/0093825 A1 * 5/2004 Lee ..... E04C 3/32 52/843
2004/0200172 A1 10/2004 Beck et al.
2005/0066611 A1 * 3/2005 Brady ..... E06B 1/6092 52/633
2006/0096192 A1 * 5/2006 Daudet ..... E04C 3/07 52/204.1
2008/0006594 A1 * 1/2008 Layton ..... E06B 3/4654 211/162
2008/0250738 A1 * 10/2008 Howchin ..... E04B 2/789 52/235
2010/0058681 A1 * 3/2010 Lucey ..... E04B 1/2604 248/500
2011/0146201 A1 6/2011 Vanker et al.
2021/0062568 A1 3/2021 Johnson

OTHER PUBLICATIONS

Johnson Hardware, The Space Saver Series 1500, Product Catalog, Apr. 2007, 2 pages.
Johnson Hardware, Instructions 1575 PPK Pocket Door Frame Adapter Kit, Product Catalog, Feb. 2009, 1 page.
Johnson Hardware, What's Stronger Than Heavy-Duty? New 2060/2000 Series Pocket Door Frames, Product Brochure, Aug. 2009, 2 pages.
Johnson Hardware, For Dramatic Rooms, Pick Our Pockets, Product Brochure, Dec. 2007, 4 pages.
Johnson Hardware, Instructions, 1500 Series Pocket Door Frame, Apr. 2010, 4 pages.
Johnson Hardware, 1500 Commercial Grade Pocket Door Frame, Mar. 2016, 2 pages.

* cited by examiner

POCKET DOOR FRAME

The present invention relates to a pocket doors and, in particular, to pocket door frames.

BACKGROUND OF THE INVENTION

Various pocket door frames are known in the prior art. Examples of pocket door frames are shown, for example, in U.S. Pat. No. 2,832,105 to Parson, U.S. Pat. No. 3,058,174 to Sterling, and U.S. Pat. No. 3,400,490 to Anderson.

SUMMARY OF THE INVENTION

In one embodiment of the present invention, a pocket door frame includes a stud having a first end, a second end, a first section, a second section perpendicular to the first section, a third section perpendicular to the second section, a fourth section perpendicular to the third section, a fifth section perpendicular to the fourth section, a sixth section perpendicular to the fifth section, and a seventh section perpendicular to the sixth section. The first section extends from the second section toward the fourth section and the seventh section extends from the sixth section toward the fourth section. A first opening is located at least partially in the third section and at least partially in the fourth section. A second opening is located at least partially in the fourth section and at least partially in the fifth section. A third opening is located in the second section and is aligned with the first opening so as to be accessible through the first opening. A fourth opening is located in the sixth section and is aligned with the second opening so as to be accessible through the second opening.

In one embodiment, the pocket door frame further includes a bracket having a base and at least four posts. The first post has a first section in contact with the first section of the stud, a second section in contact with the second section of the stud and a third section in contact with the third section of the stud. The second post has a first section in contact with the third section of the stud and a second section in contact with the fourth section of the stud. The third post has a first section in contact with the fourth section of the stud, and a second section in contact with the fifth section of the stud. The fourth post has a first section in contact with the fifth section of the stud, a second section in contact with the sixth section of the stud and a third section in contact with the seventh section of the stud.

In another embodiment, the pocket door frame includes a header contacting the second section of the stud and the sixth section of the stud, a pocket end jam bracket, a passage end jam bracket, and a track.

In one embodiment of the present invention, a pocket door frame includes a stud having a first section, a second section parallel to the first section, a third section parallel to the first and second sections, a first opening located in the first section, a second opening located in the second section, a third opening located at least partially in the third section, and a fourth opening located at least partially in the third section.

In one embodiment, the third opening is at least partially aligned with the first opening. In another embodiment, the fourth opening is at least partially aligned with the second opening.

In certain embodiments, the first and second sections are in the same plane. In other embodiments, the third section is spaced apart from the first and second sections. In yet another embodiment, the third section is in a different plane than are the first and second sections.

In one embodiment, the stud further includes a fourth section perpendicular to the first section and the third section, and the third opening is located at least partially in the third and fourth sections. In other embodiments, the fourth section is connected to the first and third sections.

In another embodiment, the pocket door frame further includes a bracket having a first post located between the first and third sections and a second post located between the second and third sections.

In certain embodiments, the pocket door frame further includes a header contacting the first and second sections of the stud.

In one embodiment of the present invention, a pocket door frame includes a header, a track and a stud. The stud includes a first section, a second section connected to and perpendicular to the first section, a third section connected to and perpendicular to the second section, a first opening in the first section, and a second opening located at least partially in the second section and at least partially in the third section. The second opening is at least partially aligned with the first opening so as to provide access to the first opening through the second opening.

In one embodiment, the first section of the stud contacts the header. In another embodiment, the first and second sections of the stud are located in different planes. In certain embodiments, the pocket door frame further includes a bracket having a least one post located at least partially between the first and third sections of the stud.

In one embodiment of the present invention, a pocket door frame includes a header, a track, and a stud. The stud includes a first section, a second section connected to and perpendicular to the first section, a third section connected to and perpendicular to the second section, a first opening in the first section, and means for accessing the first opening through the third section of the stud.

In one embodiment, the means for accessing the first opening through the third section of the stud includes a second opening located at least partially in the third section of the stud. In other embodiments, the second opening is located at least partially in the second section of the stud.

These and other features of the present invention will be apparent from the following detailed description of embodiments of the invention and accompanying drawings.

DETAILED DESCRIPTION OF EMBODIMENTS OF THE INVENTION

Figure 1:
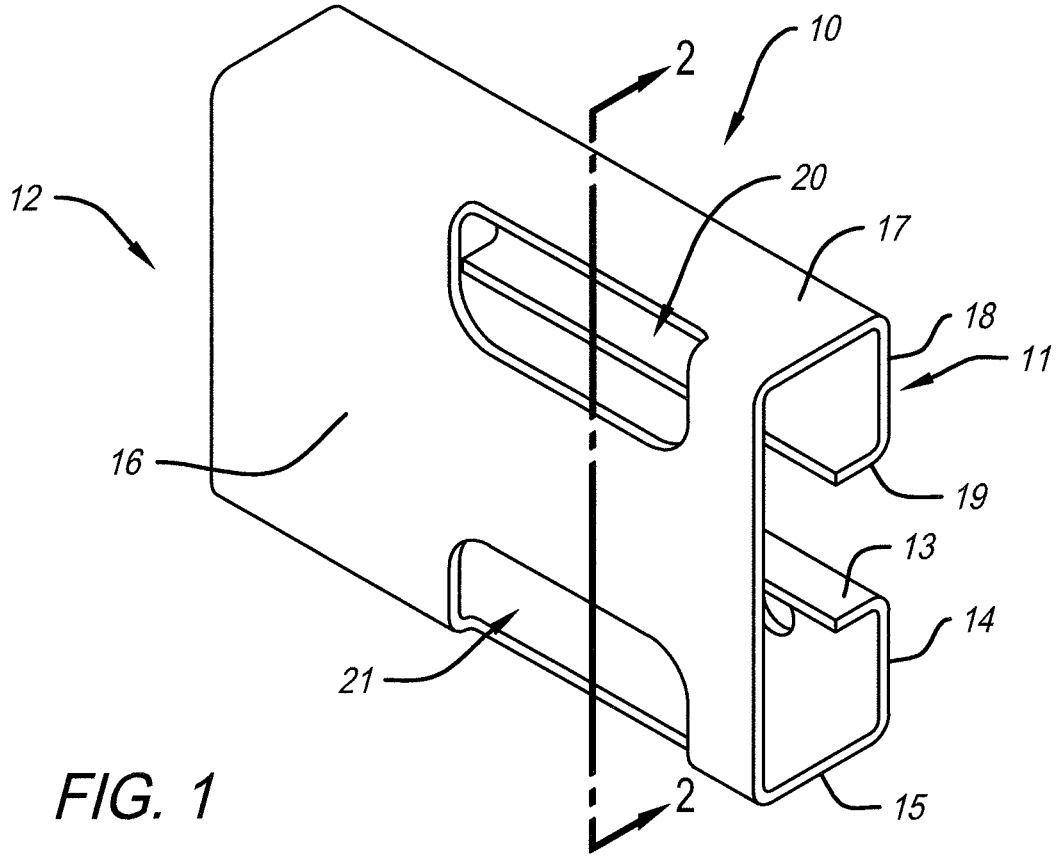
FIG. 1 is a perspective view of a section of a pocket door frame stud according to one embodiment of the present invention.
Figure 2:
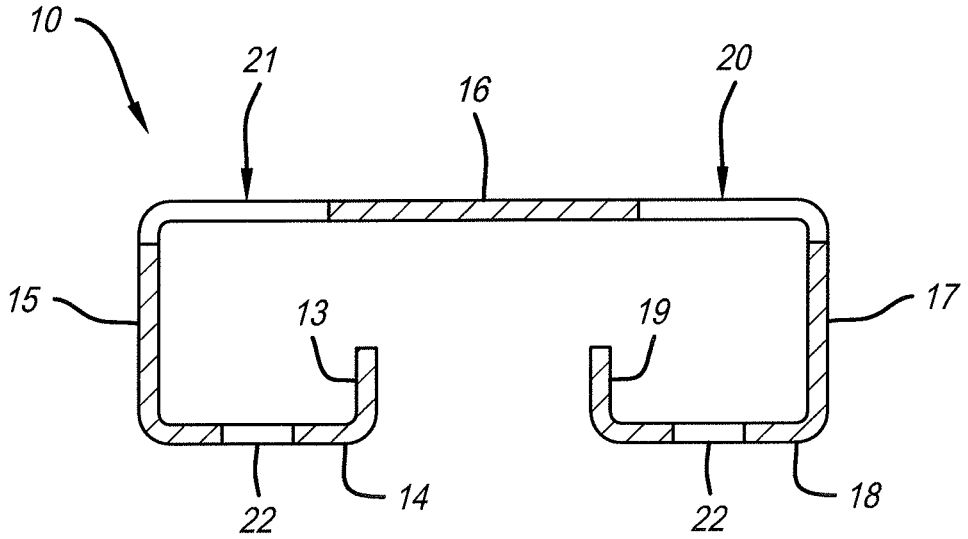
FIG. 2 is sectional view taken through line 2-2 in FIG. 1.
Figure 3:
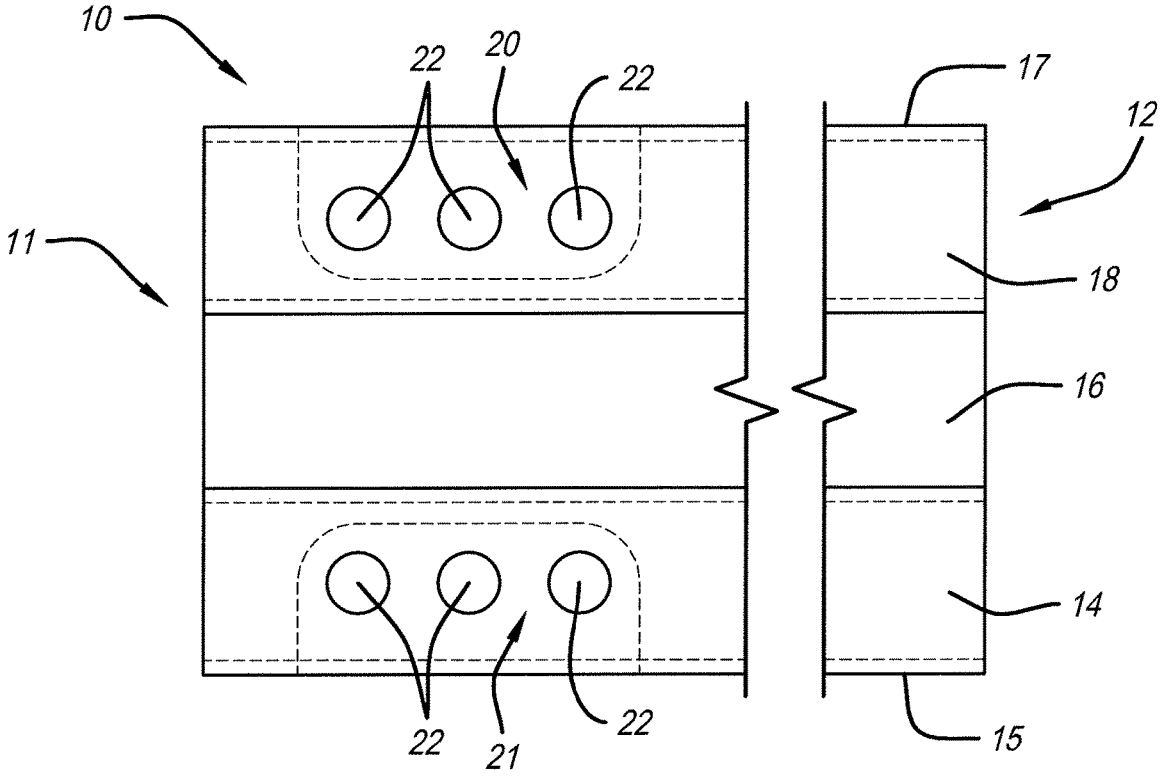
FIG. 3 is a right side elevational view of the pocket door frame stud shown in FIG. 1.
Figure 4:
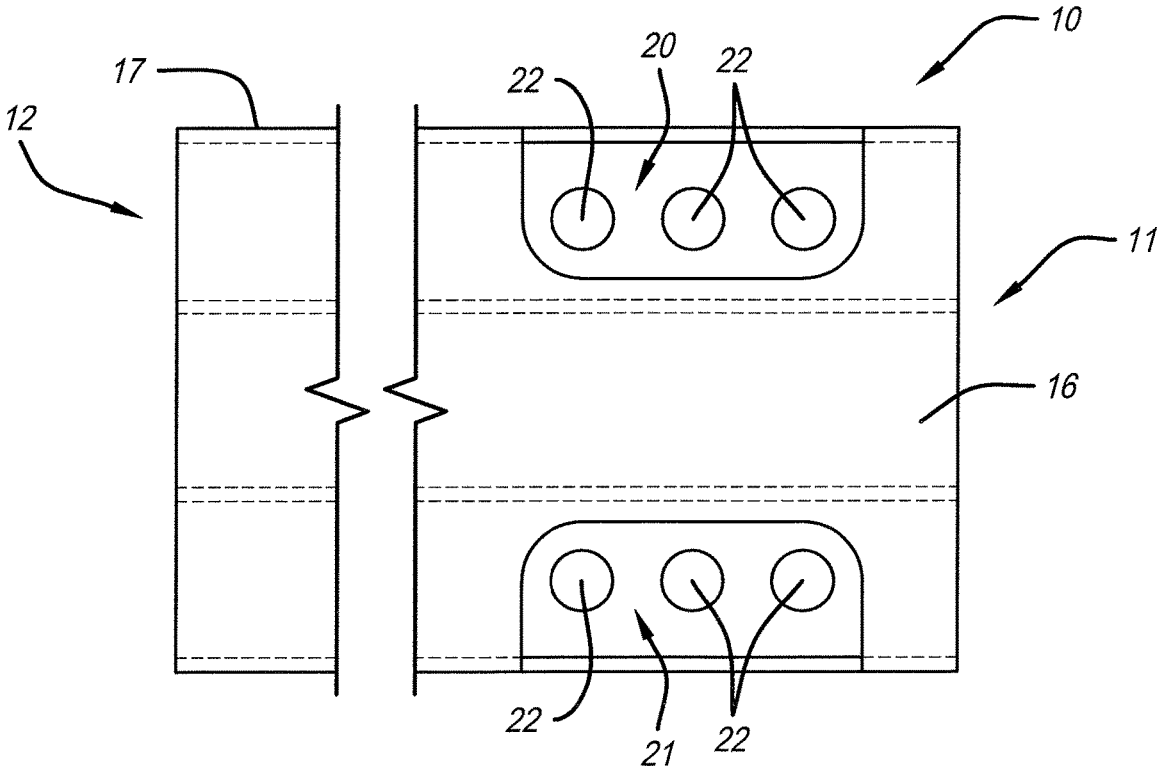
FIG. 4 is a left side elevational view of the pocket door frame stud shown in FIG. 1.
Figure 5:
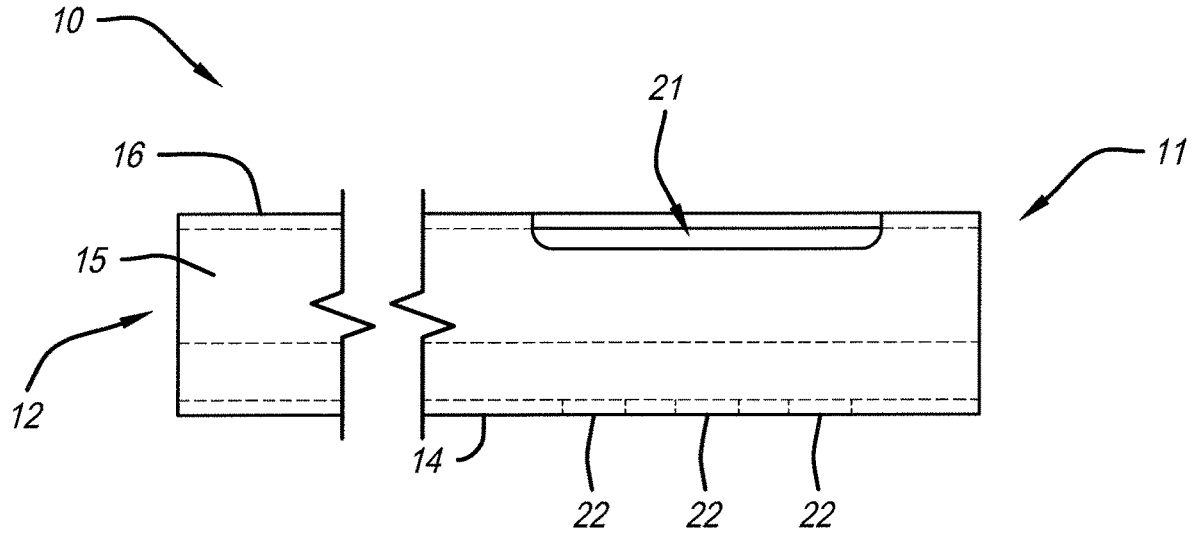
FIG. 5 is a bottom plan view of the pocket door frame stud shown in FIG. 1.

FIGS. 1-5 illustrate a pocket door frame stud according to one embodiment of the present invention. In the embodiment shown, pocket door frame stud 10 has a first end 11 and a second end 12. Note that although only a small section of stud 10 is illustrated in FIG. 1, stud 10 can be manufactured in any desired length. Stud 10 in the embodiment shown also includes a first section 13, a second section 14 disposed generally perpendicular to first section 13, a third section 15 disposed generally perpendicular to second section 14, a fourth section 16 disposed generally perpendicular to third section 15, a fifth section 17 disposed generally perpendicular to fourth section 16, a sixth section 18 disposed generally perpendicular to fifth section 17 and a seventh section 19 disposed generally perpendicular to sixth section 18. In the embodiment shown, first section 13 and seventh section 19 extend from second section 14 and sixth section 18, respectively, inward toward fourth section 16. A first opening 20 is formed in fourth section 16 and fifth section 17 and a second opening 21 is formed in third section 15 and fourth section 16 as shown in FIG. 1. One or more openings 22 are formed in second section 14 and sixth section 18 and positioned so as to be accessible from fourth section 16 through first opening 20 and second opening 21. Studs 10 may be produced from any material with sufficient strength and rigidity. In one embodiment of the present invention, studs 10 are produced from steel.

Figure 6:
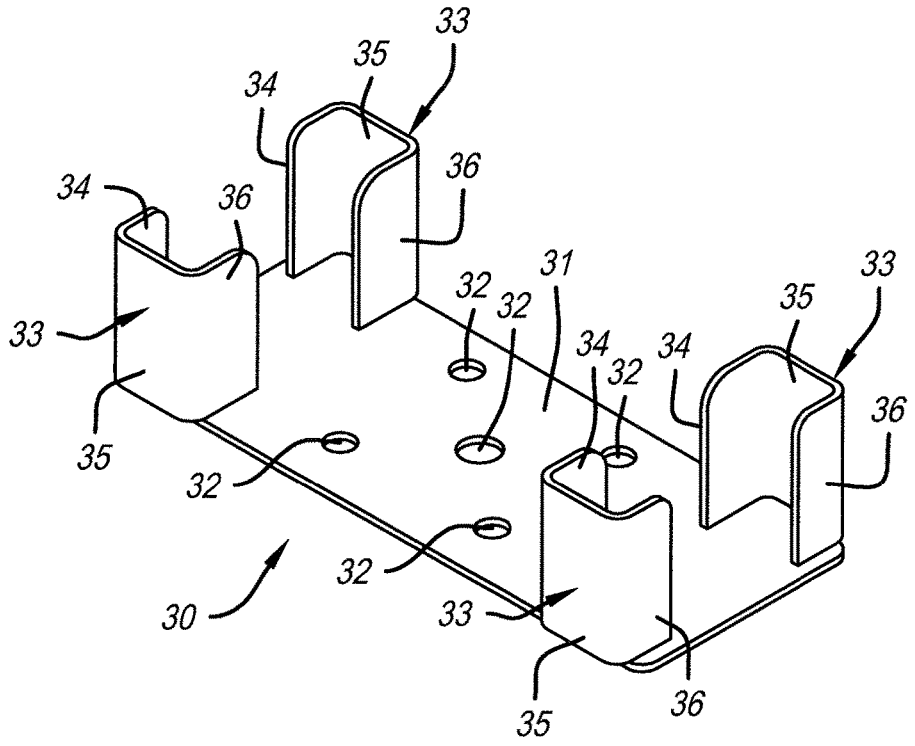
FIG. 6 is a perspective view of a bracket that is a component of a pocket door frame according to one embodiment of the present invention.

FIG. 6 is a perspective view of a bracket that is a component of a pocket door frame according to one embodiment of the present invention. In the embodiment shown, bracket 30 includes a base 31 having one or more openings 32 formed therein and one or more uprights or posts 33 connected to base 31 at each corner thereof. In the embodiment shown, posts 33 are generally U-shaped members, each of which has a first section 34, a second section 35 disposed general perpendicular to first section 34, and a third section 36 disposed generally perpendicular to second section 35. Posts 33 are sized and configured to fit within the interior of stud 10. In the embodiment shown, each post 33 is configured such that it can fit in the interior portion of stud 10 that is generally bounded by first section 13, second section 14, third section 15 and fourth section 16 and/or fourth section 16, fifth section 17, sixth section 18 and seventh section 19.

Figure 7:
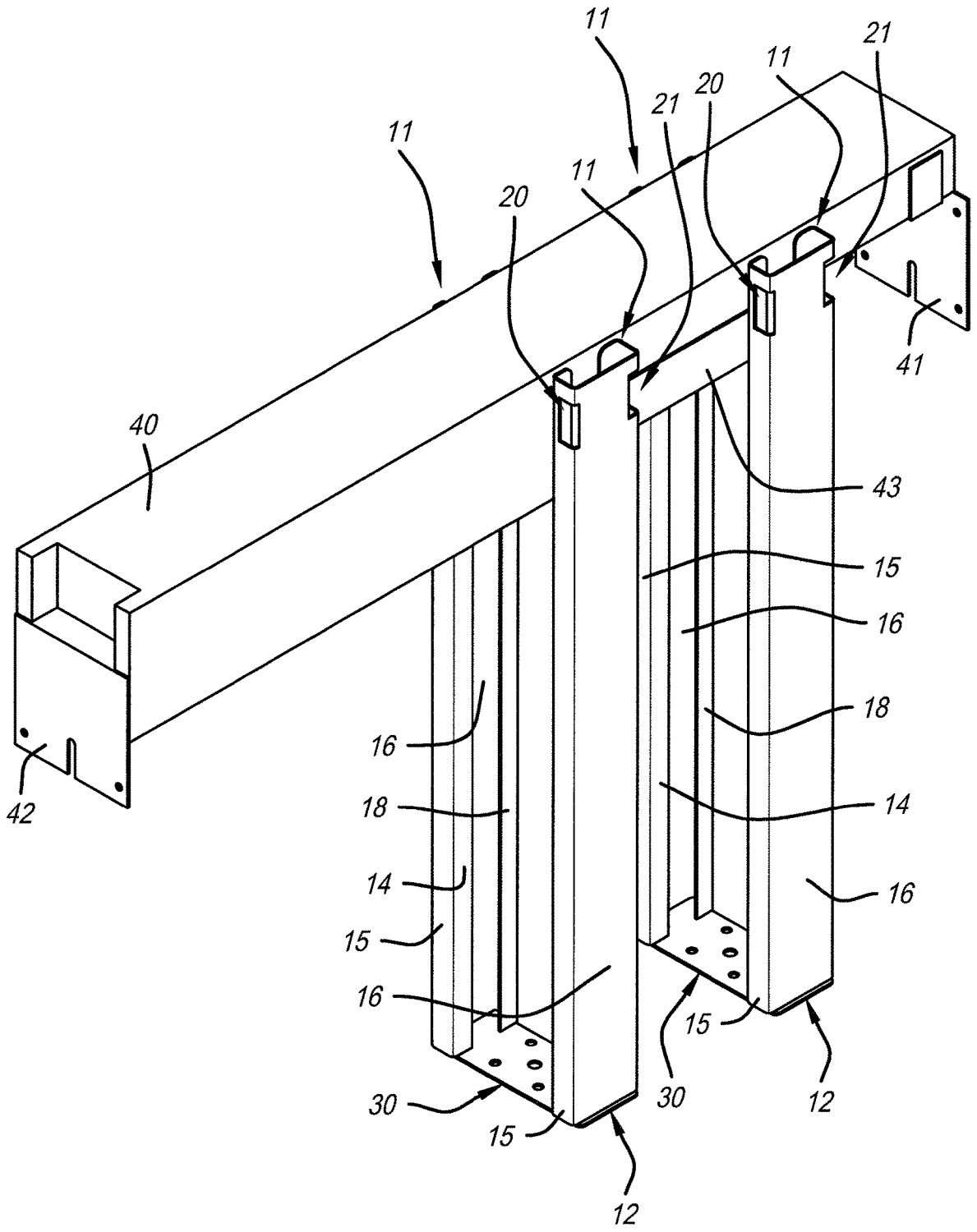
FIG. 7 is a perspective view of the pocket door frame stud shown in FIG. 1 and the bracket shown in FIG. 7 assembled to form a pocket door frame according to one embodiment of the present invention.

In use, one or more brackets 30 are secured to a floor or other support surface such that posts 33 extend upwardly. Brackets 30 may be secured to a floor or support surface via any number of means, including by inserting fasteners such as bolts or other anchoring devices through openings 32 in base 31. Studs 10 are then positioned on brackets 30 such that posts 33 extend into the interior of studs 10 (FIG. 7). Multiple brackets 30 and studs 10 may be utilized to form a pocket door frame as shown in FIG. 7. The pocket door frame includes, in addition to brackets 30 and studs 10, a header 40, a pocket end jam bracket 41, a passage end jam bracket 42 and a track 43 on which a pocket door (not shown) rides as is known in the art. Studs 10 are positioned such that second section 14 and sixth section 18 contact header 40. Note also that studs 10 are positioned such that first opening 20 and second opening 21 face outwardly away from header 40. This provides access to openings 22 such that screws, bolts or other fasteners or securing devices may be inserted through first opening 20 and second opening 21 into openings 22 to secure studs 10 to header 40.

Note that unlike certain prior art pocket door frame studs, stud 10 is configured so as to have sufficient rigidity and strength without the need for internal reinforcement. Stated another way, stud 10 of the present invention is a hollow, unreinforced member.

Although the present invention has been shown and described in detail, the same is by way of example only and should not be taken as a limitation on the invention. Numerous modifications can be made to the embodiments disclosed without departing from the scope of the present invention. For example, the particular configuration of stud 10 could be altered while still providing sufficient rigidity and strength to function without internal reinforcement.

What is claimed is:

1. A pocket door frame, the pocket door frame having a stud including:
- a first end;
- a second end;
- a first section;
- a second section perpendicular to the first section;
- a third section perpendicular to the second section;
- a fourth section perpendicular to the third section;
- a fifth section perpendicular to the fourth section;
- a sixth section perpendicular to the fifth section;
- a seventh section perpendicular to the sixth section;
- wherein the first section extends from the second section toward the fourth section and the seventh section extends from the sixth section toward the fourth section;
- a first opening, the first opening located at least partially in the third section and at least partially in the fourth section;
- a second opening, the second opening located at least partially in the fourth section and at least partially in the fifth section;
- a third opening located in the second section, the third opening aligned with the first opening so as to be accessible through the first opening; and
- a fourth opening located in the sixth section, the fourth opening aligned with the second opening so as to be accessible through the second opening.

2. The pocket door frame according to claim 1, further including a bracket having:
- a base;
- a first post having a first section in contact with the first section of the stud, a second section in contact with the second section of the stud and a third section in contact with the third section of the stud;
- a second post having a first section in contact with the third section of the stud and a second section in contact with the fourth section of the stud;
- a third post having a first section in contact with the fourth section of the stud, and a second section in contact with the fifth section of the stud; and
- a fourth post having a first section in contact with the fifth section of the stud, a second section in contact with the sixth section of the stud and a third section in contact with the seventh section of the stud.

3. The pocket door frame according to claim 2, further including:
- a header contacting the second section of the stud and the sixth section of the stud;
- a pocket end jam bracket;
- a passage end jam bracket; and
- a track.

4. A pocket door frame, the pocket door frame having a stud including:

a first section;

a second section parallel to the first section;

a third section parallel to the first and second sections;

a fourth section perpendicular to the first section and the third section;

a first opening located in the first section;

a second opening located in the second section;

a third opening located at least partially in the third and fourth sections; and a fourth opening located at least partially in the third section.

5. The pocket door frame according to claim 4, wherein the third opening is at least partially aligned with the first opening.

6. The pocket door frame according to claim 5, wherein the fourth opening is at least partially aligned with the second opening.

7. The pocket door frame according to claim 4, wherein the first and second sections are in the same plane.

8. The pocket door frame according to claim 4, wherein the third section is spaced apart from the first and second sections.

9. The pocket door frame according to claim 4, wherein the third section is in a different plane than are the first and second sections.

10. The pocket door frame according to claim 4, wherein the fourth section is connected to the first and third sections.

11. The pocket door frame according to claim 4, further including a bracket having a first post located between the first and third sections and a second post located between the second and third sections.

12. The pocket door frame according to claim 4, further including a header contacting the first and second sections of the stud.

13. A pocket door frame, including:

a header;

a track; and a stud, the stud including a first section, a second section connected to and perpendicular to the first section, a third section connected to and perpendicular to the second section, a first opening in the first section, and a second opening located at least partially in the second section and at least partially in the third section, the second opening at least partially aligned with the first opening so as to provide access to the first opening through the second opening.

14. The pocket door frame according to claim 13, wherein the first section of the stud contacts the header.

15. The pocket door frame according to claim 14, wherein the first and second sections of the stud are located in different planes.

16. The pocket door frame according to claim 15, further including a bracket having a least one post located at least partially between the first and third sections of the stud.

17. A pocket door frame, including:

a header;

a track; and a stud, the stud including a first section, a second section connected to and perpendicular to the first section, a third section connected to and perpendicular to the second section, a first opening in the first section, and means for accessing the first opening through the third section of the stud, wherein the means for accessing the first opening through the third section of the stud includes a second opening located at least partially in the second section of the stud and at least partially in the third section of the stud.

* * * * *